US008516819B2

(12) United States Patent
Gambacorta et al.

(10) Patent No.: US 8,516,819 B2
(45) Date of Patent: Aug. 27, 2013

(54) FORWARD-SECTION RESONATOR FOR HIGH FREQUENCY DYNAMIC DAMPING

(75) Inventors: Domenico Gambacorta, Oviedo, FL (US); Clifford E. Johnson, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 1229 days.

(21) Appl. No.: 12/174,187

(22) Filed: Jul. 16, 2008

(65) Prior Publication Data

US 2010/0011769 A1 Jan. 21, 2010

(51) Int. Cl.
*F02C 7/24* (2006.01)

(52) U.S. Cl.
USPC ..... 60/725; 431/114

(58) Field of Classification Search
USPC ..... 60/725, 804, 737, 733, 747; 431/114
See application file for complete search history.

(56) References Cited

U.S. PATENT DOCUMENTS

| | | | | | |
|---|---|---|---|---|---|
| 4,122,674 | A * | 10/1978 | Andersson et al. | ..... | 60/725 |
| 5,253,748 | A * | 10/1993 | Ledet | ..... | 198/834 |
| 5,373,695 | A | 12/1994 | Aigner et al. | | |
| 5,431,018 | A | 7/1995 | Keller | | |
| 5,644,918 | A | 7/1997 | Gulati et al. | | |
| 6,122,916 | A * | 9/2000 | Amos et al. | ..... | 60/747 |
| 6,351,947 | B1 | 3/2002 | Keller et al. | | |
| 6,530,221 | B1 * | 3/2003 | Sattinger et al. | ..... | 60/725 |
| 7,089,741 | B2 * | 8/2006 | Ikeda et al. | ..... | 60/725 |
| 2004/0163392 | A1 * | 8/2004 | Nishida et al. | ..... | 60/737 |
| 2005/0144950 | A1 | 7/2005 | Flohr et al. | | |

* cited by examiner

*Primary Examiner* — Andrew Nguyen

(57) ABSTRACT

A gas turbine combustor having a Helmholtz resonator in a post-swirler homogenization zone upstream of the combustor zone. Embodiments of the present invention provide Helmholtz resonators that include cavities that occupy a remainder of a post-swirler homogenization zone, which also includes at least one flow-directing structure that passes a fuel/oxidizer mixture from a main swirler assembly into a combustion zone of a combustor. Thus, an open annular region of the combustor is converted into a multi-purpose zone that includes at least one Helmholtz resonator.

10 Claims, 7 Drawing Sheets

FORWARD-SECTION RESONATOR FOR HIGH FREQUENCY DYNAMIC DAMPING

FIELD OF INVENTION

The invention generally relates to a gas turbine engine, and more particularly to a Helmholtz resonator positioned in a particular upstream zone of a combustor of a gas turbine engine.

BACKGROUND OF THE INVENTION

Combustion engines such as gas turbine engines are machines that convert chemical energy stored in fuel into mechanical energy useful for generating electricity, producing thrust, or otherwise doing work. These engines typically include several cooperative sections that contribute in some way to this energy conversion process. In gas turbine engines, air discharged from a compressor section and fuel introduced from a fuel supply are mixed together and burned in a combustion section. The products of combustion are harnessed and directed through a turbine section, where they expand and turn a central rotor.

A variety of combustor designs exist, with different designs being selected for suitability with a given engine and to achieve desired performance characteristics. One popular combustor design includes a centralized pilot burner (hereinafter referred to as a pilot burner or simply pilot) and several main fuel/air mixing apparatuses, generally referred to in the art as injector nozzles, swirlers, main swirlers or main swirler assemblies, arranged circumferentially around the pilot burner. With this design, a central pilot flame zone and a mixing region are formed. During operation, the pilot burner selectively produces a stable flame that is anchored in the pilot flame zone, while the fuel/air mixing apparatuses produce a mixed stream of fuel and air in the above-referenced mixing region. The stream of mixed fuel and air flows out of the mixing region, past the pilot flame zone, and into a main combustion zone of a combustion chamber, where additional combustion occurs. Energy released during combustion is captured by the downstream components to produce electricity or otherwise do work.

It is known that high frequency pressure oscillations may be generated from the coupling between heat release from the combustion process and the acoustics of the combustion chamber. If these pressure oscillations, which are sometimes referred to as combustion dynamics, or as high frequency dynamics ("HFD"), reach a certain amplitude they may cause nearby structures to vibrate and ultimately break. A particularly undesired situation is when a combustion-generated acoustic wave has a frequency at or near the natural frequency of a component of the gas turbine engine. Such adverse synchronicity may result in sympathetic vibration and ultimate breakage or other failure of such component.

Various resonator boxes for the combustion section of a gas turbine engine have been developed to damp such undesired acoustics and reduce the risk of the above-noted problems. For example, U.S. Pat. No. 5,373,695, issued Dec. 20, 1994 to Aigner et al., teaches a "scavenged" Helmholtz resonator, consisting of a supply tube, resonance volume and damping tube, in the region of the burners. FIG. 1 of this patent shows the resonator aligned with, and not downstream of, premixing burners at the inlet end of the combustion chamber.

U.S. Pat. No. 5,644,918, issued Jul. 8, 1997 to Gulati et al. teaches forming one or more resonance cavities for Helmholtz resonators between first and second plates located in the head end of the combustor casing. These plates define a space that includes the main fuel/air mixing apparatuses, which are referred to as premixers. No pilot burner is included in this design. This patent also teaches providing a cavity between the casing and the liner, so as to form one or more Helmholtz resonators circumferentially about a portion of the combustor.

U.S. Pat. No. 7,089,741, issued Aug. 15, 2006 to Ikeda et al. teaches forming a resonance space about a wall of a combustion liner that defines a combustion region. The resonance space connects to the combustion region by a plurality of through-holes. Additionally, cooling holes are provided along the sides of housings that help define the resonance space, stated as desirable along an upstream side and also shown along a downstream side. Purge holes also are provided along a more radially outwardly disposed surface.

While the above approaches may provide one or more favorable features, to address undesired combustion-generated acoustic waves there still remains in the art a need for a more effective and efficient resonator.

BRIEF DESCRIPTION OF THE DRAWINGS

The invention is explained in following description in view of the drawings that show.

DETAILED DESCRIPTION OF EMBODIMENTS OF THE INVENTION

It is generally appreciated that damping resonators, such as Helmholtz resonators, that are disposed relatively downstream of a primary region of combustion have a disadvantage: the compressed air passing through such resonators, into the hot gas path, represents an inefficient use of such air. This is because such air flowing through the resonator may not be fully used in the combustion process. More upstream resonators, including those described above, often present complex structural additions in a region that already has space demands for a number of components and functions.

The present inventors have appreciated a solution to providing an effective Helmholtz resonator arrangement by utilizing an annular region in the combustor not previously utilized for such purpose. In various embodiments this also improves performance in ways in addition to vibration damping.

Figure 1:
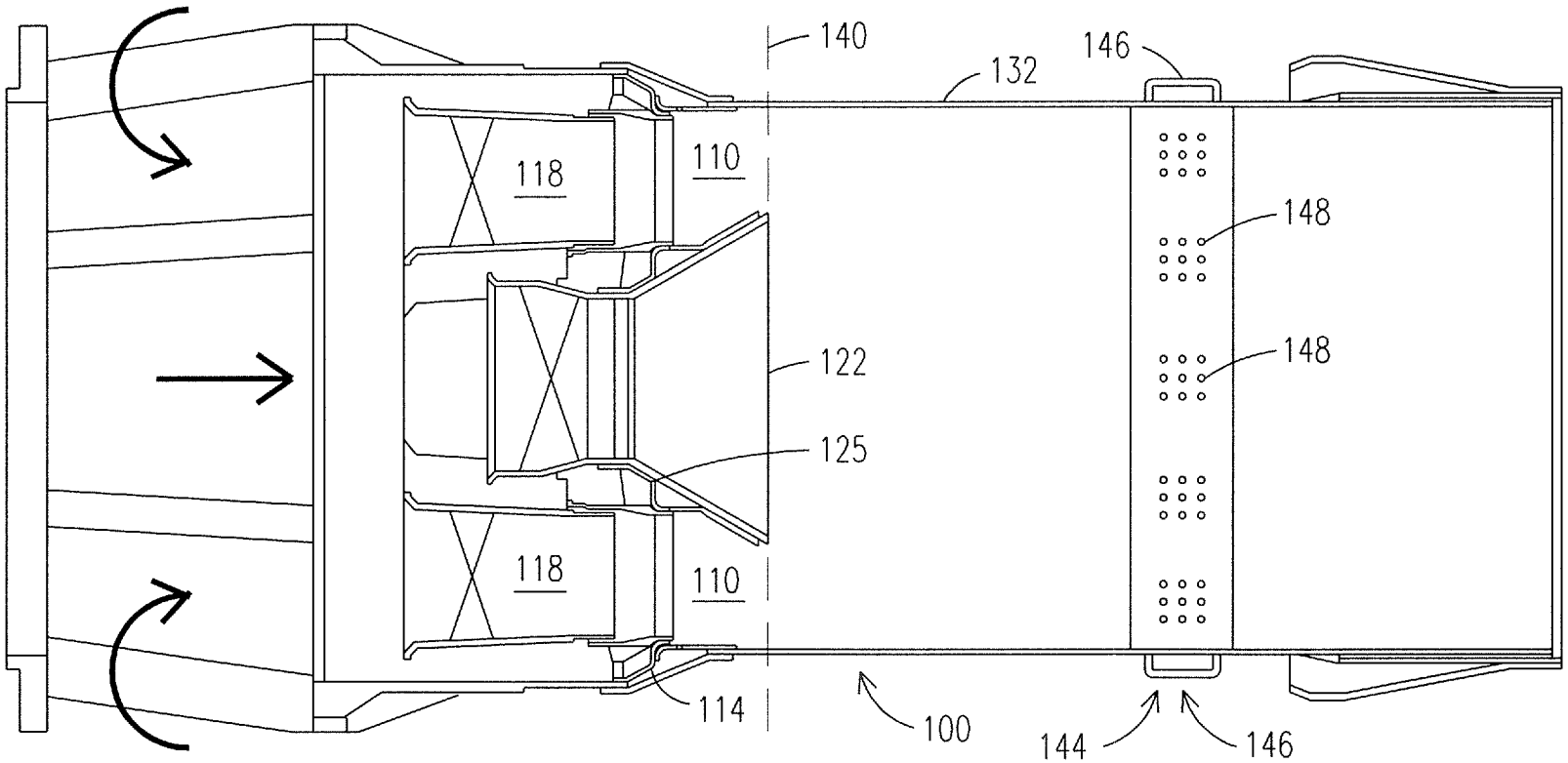
FIG. 1 (PRIOR ART)
FIG. 1 provides a cross-sectional side view of a representative prior art combustor.

In many gas turbine combustors there exists an annular region having a primary function of providing a residence time for greater mixing of the fuel/air mixture after it leaves a main swirler. The residence time of a mixture through this region allows the fuel/air mixture to achieve a greater uniformity. In a range of particular gas turbine combustors, this annular region, hereinafter referred to as a post-swirler homogenization zone, begins at the base plate, ends at a plane that includes the downstream edge of the pilot cone, and excludes the space within the pilot cone. This post-swirler homogenization zone is identified as 110 in FIG. 1. Other identified components of combustor 100 are main swirler assembly 118, base plate 114, and pilot cone 122. A downstream plane 140 is the plane that includes a downstream edge of the pilot cone 122. Also viewable in FIG. 1 is a pilot cone 122 including an outer cone 125. The outer cone may comprise a plurality of cooling apertures (not shown, see FIG. 2) effective to provide a cooling flow to the inner cone which is exposed to heat from combustion. Finally, also viewable are conventional downstream Helmholtz resonators 144 that comprise spaced apart housings 146 each covering a plurality of apertures 148 in the liner near the downstream end of a combustor liner 132.

Various embodiments of the present invention share a common concept: they modify the conventional post-swirler homogenization zone 110 into a combination Helmholtz resonator-fuel/air mixing region, wherein the fuel/air mixing region is defined at least in part by a flow-directing structure. This not only provides for efficient space utilization to achieve a resonator function, but in at least some embodiments constrains the post-swirler homogenization zone. Such constraining allows for one or more Helmholtz resonators to comprise a portion of this zone that remains after provision of the fuel/air mixing region(s) defined by flow-directing structure(s), such as is described in the examples that follow.

In various embodiments the present invention is achieved by forming a plurality of flow-directing structures, each aligned with one of the main swirlers and a top plate at or near, and parallel with, the pilot cone plane. The area outside of the flow-directing structures, together with the base plate, the newly provided top plate and the outer pilot cone, define a complex-shaped volume that remains separated from the fuel/air flow paths from the main swirlers and from the pilot. This remaining volume is referred to below as the remainder. This complex-shaped remainder may be utilized for all or part of cavities of one or more Helmholtz resonators.

The figures discussed below depict non-limiting embodiments of the present invention.

Figure 2:
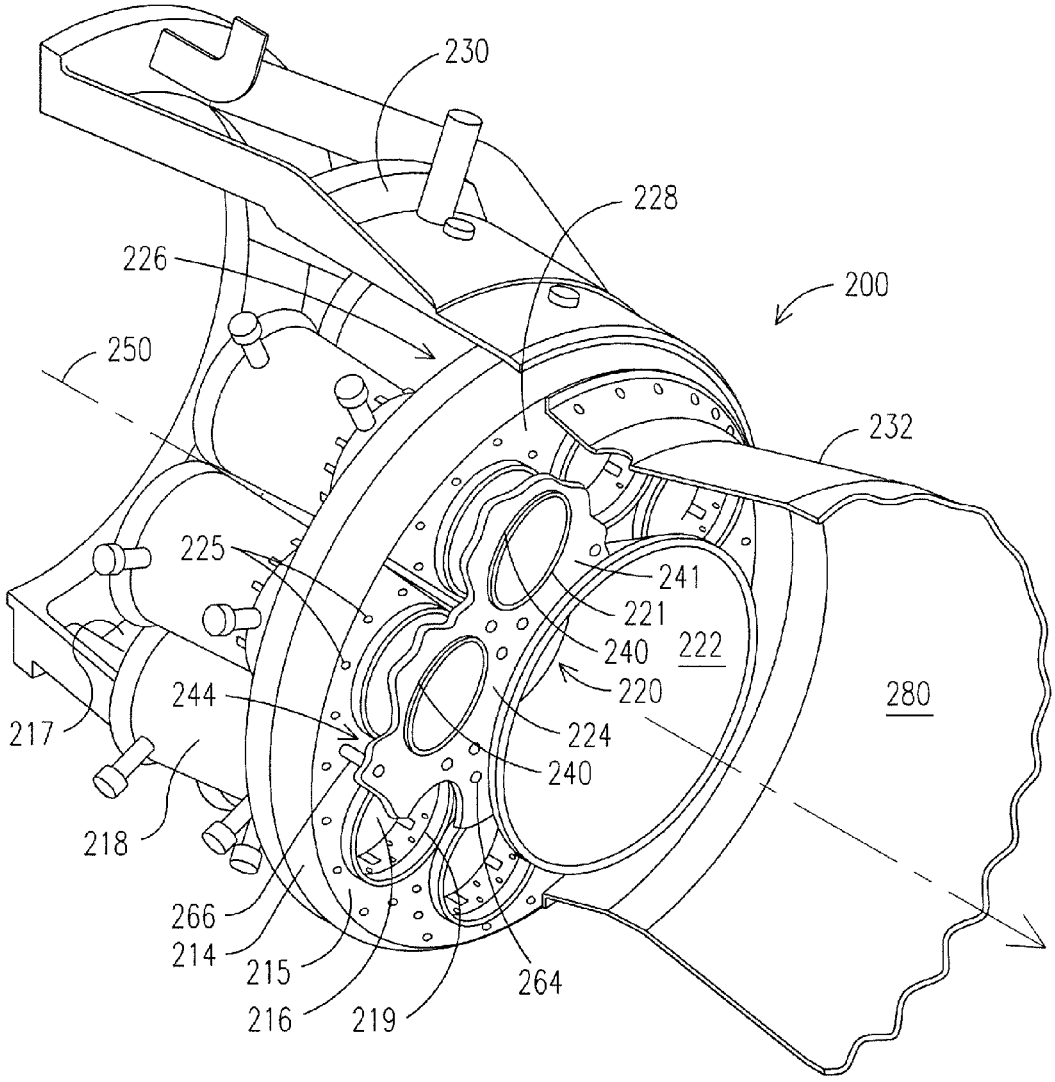
FIG. 2 provides a partial cut-away perspective view of a combustor embodiment depicting features of the present invention.

FIG. 2 provides a partial cut-away perspective view of a combustor 200 having slightly different basic features of the combustor of FIG. 1, and also including exemplary components of the present invention. As to the basic features, the combustor 200 comprises a base plate 214 having a transverse wall 215 extending perpendicularly to a longitudinal flow-axis 250 of the combustor 200. The base plate transverse wall 215 comprises at least one aperture 216 (referred to by some in the field as an "extruded hole") for a main swirler assembly 218 and a centrally disposed aperture 220 for a pilot burner, which is followed downstream by a pilot cone 222, having a downstream edge 224. The base plate 214 having a plurality of optional axially-directed apertures 225 for passage of air from an upstream side 226 to a downstream side 228 of the base plate 214. Each main swirler assembly 218 comprises an upstream end 217 and a downstream end 219.

Enclosing a space that includes a combustion zone 280 is a liner 232. A flow-directing structure 240 extends from the downstream end 219 of a respective main swirler assembly 218 to a top plate structure 241, thereby directing a fuel/air mixture (not shown) from the respective swirler assembly 218 into the combustion zone 280 that begins substantially adjacent the downstream edge 224 of the pilot cone 222.

Referring in part to FIG. 1, it is appreciated that a remainder 244 exists between all of the flow-directing structures 240, base plate 214, top plate 241 and liner 232. A Helmholtz resonator comprises the remainder 244 as its cavity and apertures 264 in the top plate 241 communicating with said cavity. In the embodiment of FIG. 2, the axially directed apertures 225 of the base plate 214 also communicate with the cavity and provide a cooling air flow (not shown) for the Helmholtz resonator that also provides additional air for combustion purposes. An optional tube 266 extending upstream from an aperture 264 is shown to indicate that in various embodiments tubes such as 266 may be employed to extend the throat of a Helmholtz resonator to achieve damping of a desired frequency based on recognized formulae.

It is appreciated that in other embodiments the remainder 244 may be subdivided into one or more cavities for one or more Helmholtz resonators, and/or a particular Helmholtz resonator may include a cavity that includes a portion of the remainder and additional volume from space not in the post-swirler homogenization zone. As an example, FIG. 3A, a plane view of a top plate 342 from the downstream side, shows lines that indicate partitions 365 between the base plate (not shown, see FIGS. 1 and 2) and the top plate 342. Such partitions 365 thereby form three Helmholtz resonator cavities 370, 371, and 372.

In contrast to more complex top plates, one example of which is described below, the top plate 342 in FIG. 3A occupies a single plane transverse to the flow direction and comprises an inner annular edge 343. Similarly, an outer edge 345 of the top plate 342 may be attached to the liner (not shown, see FIGS. 1 and 2) by welding or other methods known to those skilled in the art.

Figure 3A:
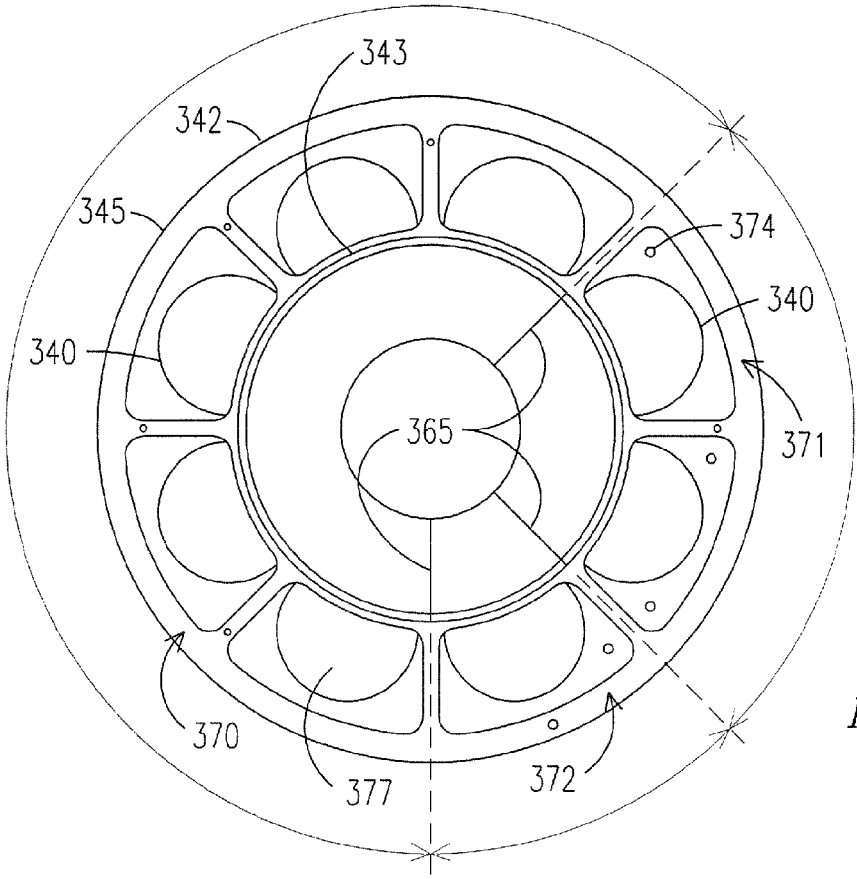
FIG. 3A depicts a plane view of a top plate embodiment of the present invention from the downstream side, showing lines that indicate partitions between the base plate and the top plate.
Figure 3B:
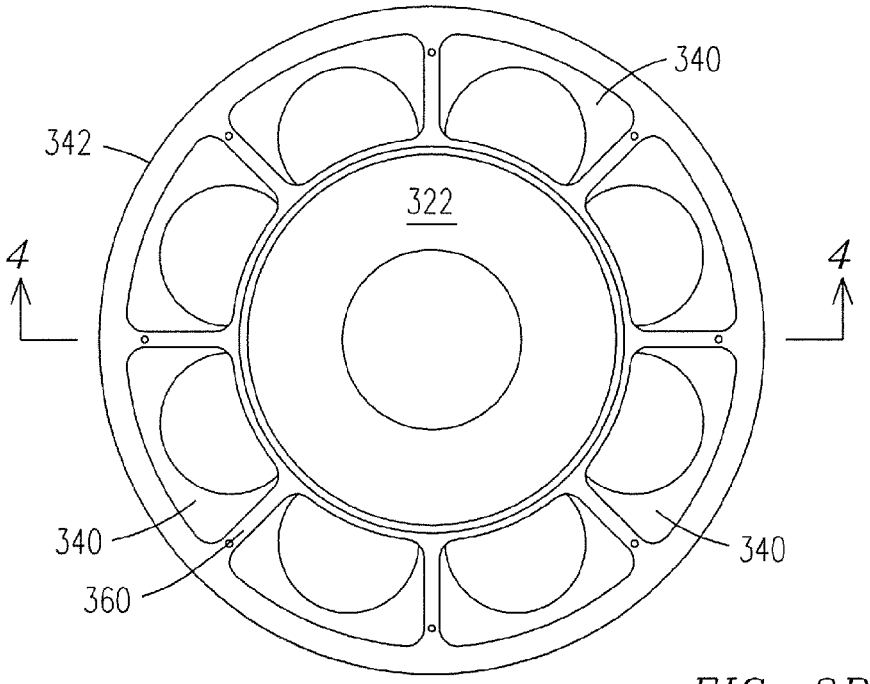
FIG. 3B shows a similar top plate view however without such partitions.

FIG. 3B shows a similar plane view without such partitions. This would provide a single Helmholtz resonator 360 having a cavity occupying essentially the entire remainder.

In both FIGS. 3A and 3B the passageways 377 in the top plate 342 provide for the flow of the fuel/air mixture from the main swirler assemblies (see FIGS. 1 and 2) through the flow-directing structures 340. Generally, the shape of top plate passageways may be circular, oval, or any shape selected to provide a desired flow pattern and to balance other factors and performance criteria.

Figure 4:
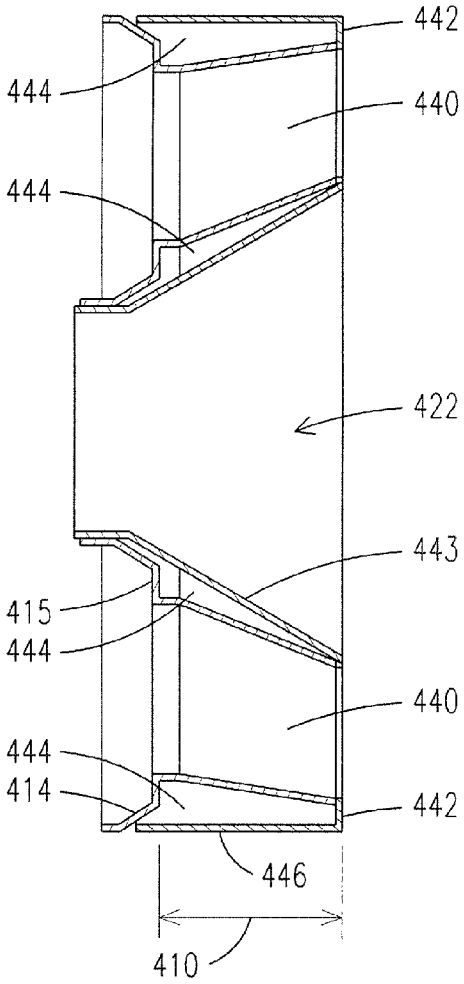
FIG. 4 provides a cross-sectional view taken along 4-4 of FIG. 3B.

FIG. 4 provides a cross-sectional view taken along 4-4 of FIG. 3B. Viewable are the base plate 414, including a portion of its transverse wall 415, two flow-directing structures 440 and a top plate 442. The post-swirler homogenization zone 410 is the region between the two imaginary lines to the side of the structure shown in FIG. 4 and within liner 446 but excluding the volume 422 defined as being within the pilot cone area. The remainder 444 is more clearly shown than in FIGS. 3A and 3B, and is seen to exist both to the interior and to the exterior of the flow-directing structures 440. It is appreciated that a portion of the remainder 444 also exists between the spaced apart, circumferentially arranged flow-directing structures 440. For clarity, the pilot cone structure was not shown in FIG. 4. This will be shown in subsequent figures.

It is noted that in some embodiments there may be an outer pilot cone and an inner pilot cone. This is shown, for example, in FIG. 1. However, in other embodiments, such as the one shown in FIG. 4, the top plate structure may include an inward conical member 443 that fulfils the functions of an outer cone.

Figure 5A:
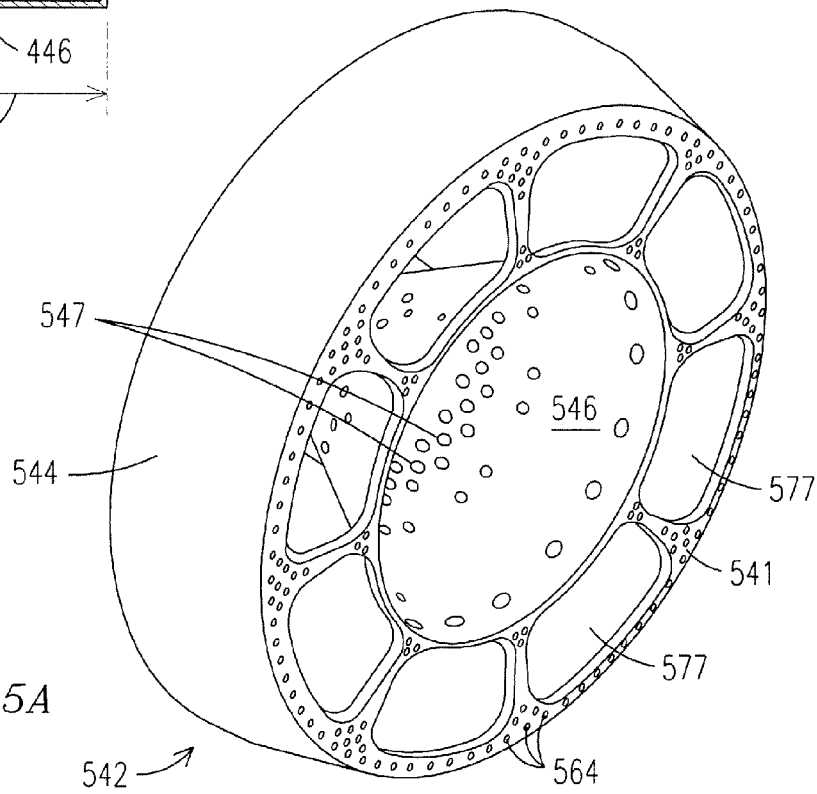
FIGS. 5A-C provides, respectively, a perspective view, a plane view from the downstream side, and a cross-section taken along line C-C of FIG. 5B of a particular embodiment of a top plate structure.
Figure 5B:
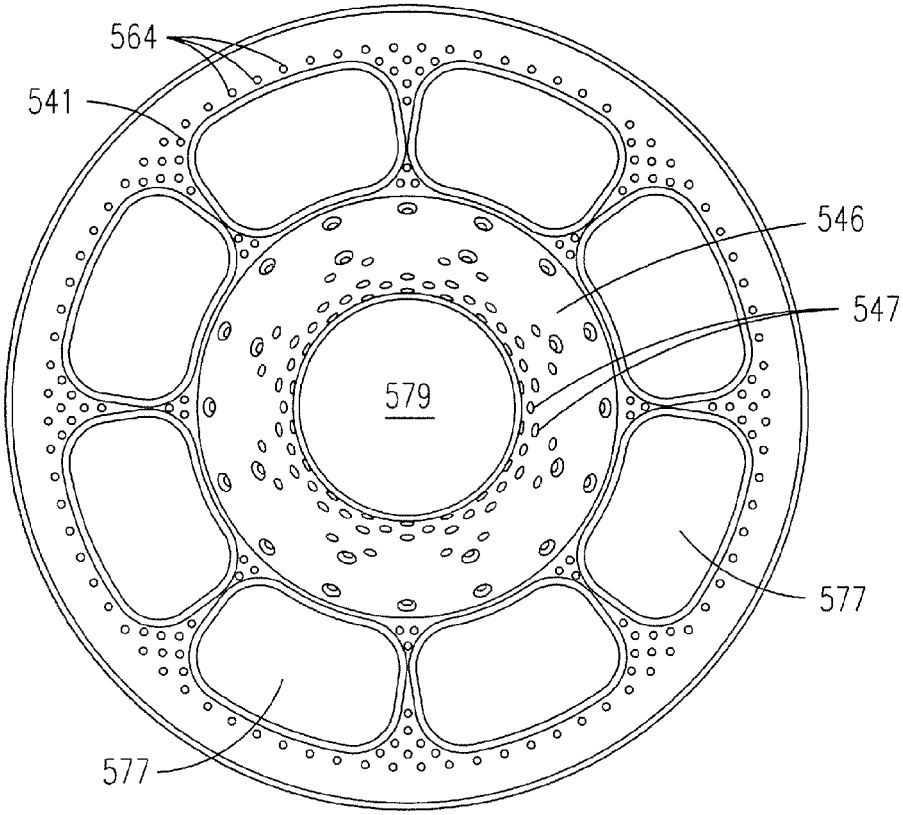
Figure 5C:
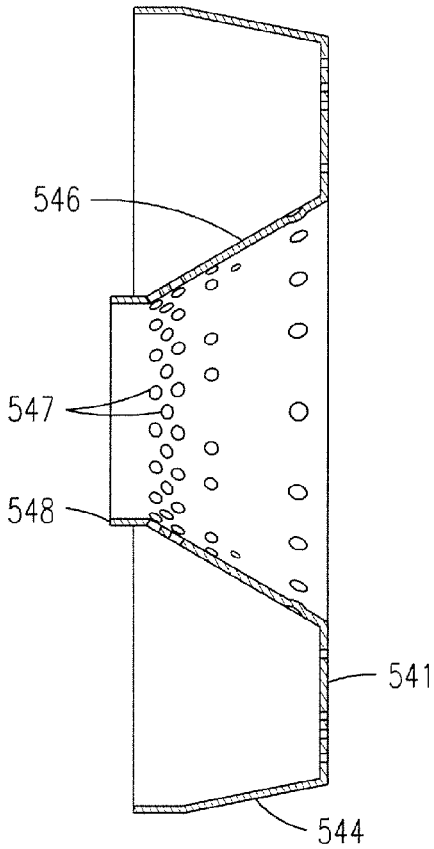

FIGS. 5A-C provide, respectively, a perspective view, a plane view from the downstream side, and a cross-section taken along line C-C of FIG. 5B of a particular embodiment of a top plate structure. The top plate structure comprises a top plate transverse wall 541, itself comprising a plurality of apertures 564 and a plurality of passageways 577 (the latter for communication with flow-directing structures), an outer shell 544, and an inner conical form 546. The inner conical form comprises optional apertures 547. The inner conical form 546 and apertures 547 are used if the intent of the top plate is to fulfill the functions of the outer cone.

Figure 5D:
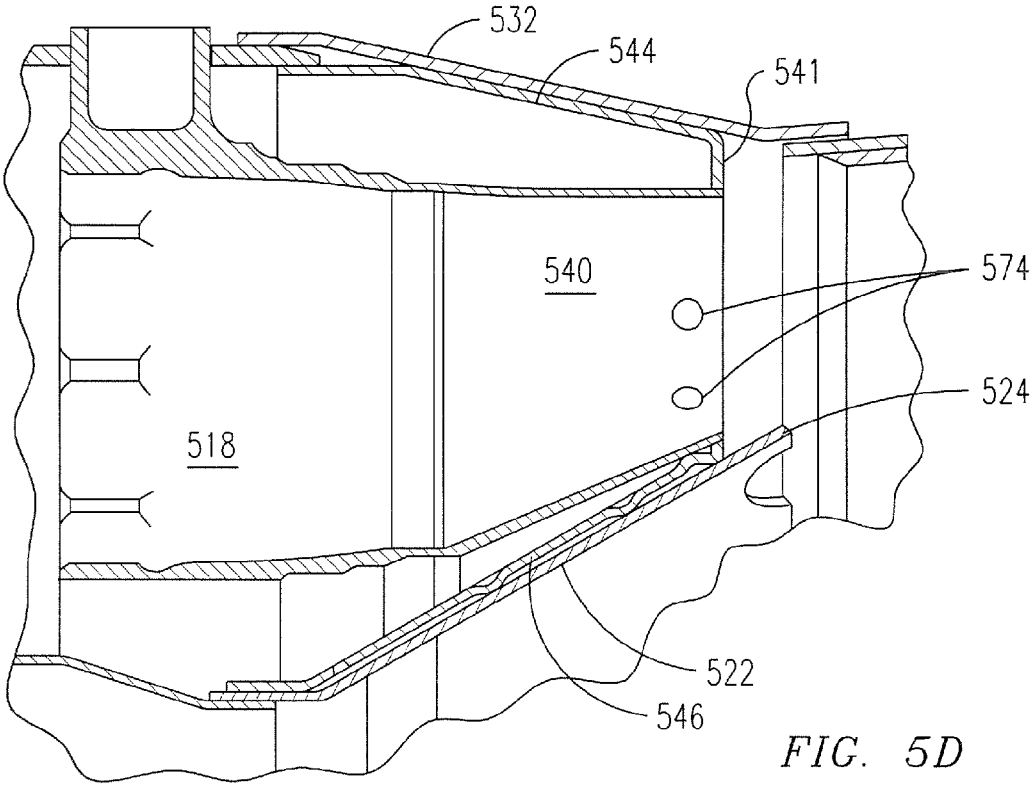
FIG. 5D provides a partial cut-away view that includes a portion of the top plate structure in association with a main swirler assembly, a flow-directing structure, a pilot cone, and a combustor liner.

FIG. 5B, the plane view from the downstream side, additionally shows a central opening 579 adapted to conform to an upstream end of a pilot cone (not shown, see FIG. 5D).

FIG. 5C, the cross-section taken along line C-C of FIG. 5B, further clarifies the design of this embodiment. An upstream edge 548 of the inner conical form 546 is identified.

FIG. 5D provides a partial cut-away view that includes a portion of the top plate structure in association with a main swirler assembly 518, a flow-directing structure 540, a pilot cone 522, and a combustor liner 532. The flow-directing structure 540 aligns with one of the passageways (see 577 in FIG. 5A) in the top plate transverse wall 541, and also with a main swirler assembly 518. The outer shell 544 conforms within a combustor liner 532, and the inner conical form 546 similarly conforms to the outside shape of an inner cone 522. Thus, here the inner conical form 546, with its apertures 547 (see FIG. 5A), provide a function similar to that of an outer pilot cone wall, namely to provide cooling of the pilot cone 522.

It is noted that in some embodiments one or more apertures that communicate with a cavity of a Helmholtz resonator of the present invention may be provided in the flow-directing structure. For example, FIG. 5D depicts two such apertures 574. Such aperture(s) 574 may be in addition to the apertures 564 shown in FIG. 5A.

Furthermore, FIG. 5D shows that the top plate transverse wall 541 need not be aligned exactly with the pilot cone downstream edge 524 or with the downstream edge of the flow guiding structure 540. In this embodiment, not meant to be limiting, the top plate transverse wall is somewhat upstream of the pilot cone downstream edge 524.

Thus, distilling features from the various embodiments explicitly depicted herein, features of the present invention are directed to a gas turbine combustor Helmholtz resonator comprising a cavity at least partly between a combustor base plate transverse wall and a transverse wall of a top plate structure and at least one aperture defining a resonator throat and communicating with a combustion zone downstream of the top plate structure transverse wall. In some embodiments the indicated at least one aperture of the top plate structure is through the top plate structure transverse wall. In various embodiments a flow-directing structure between a main swirler assembly and the top plate structure transverse wall separates a flow path from the cavity. The flow-directing structure may be aligned with a passageway in the top plate transverse wall to provide for passage of the fuel/air mixture passing from the main swirler assembly through the flow-directing structure. The at least one aperture through the top plate structure and communicating with the cavity may be through the flow-directing structure or through the top plate structure transverse wall, or elsewhere on the top plate.

Figure 6A:
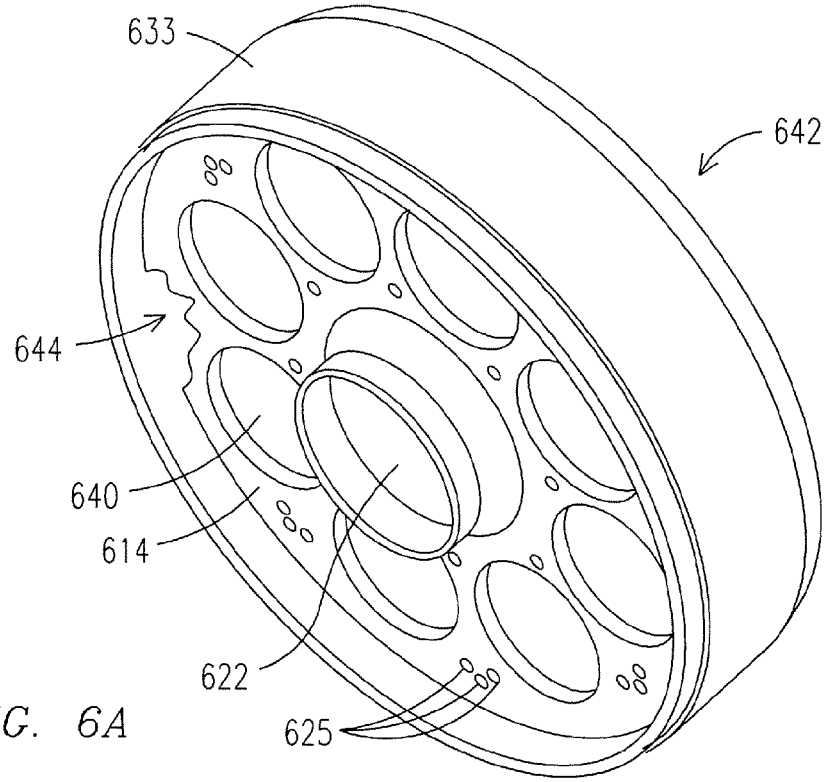
FIGS. 6A and 6B provide, respectively, an upstream side perspective view and a downstream side perspective view, of an exemplary embodiment of the present invention.
Figure 6B:
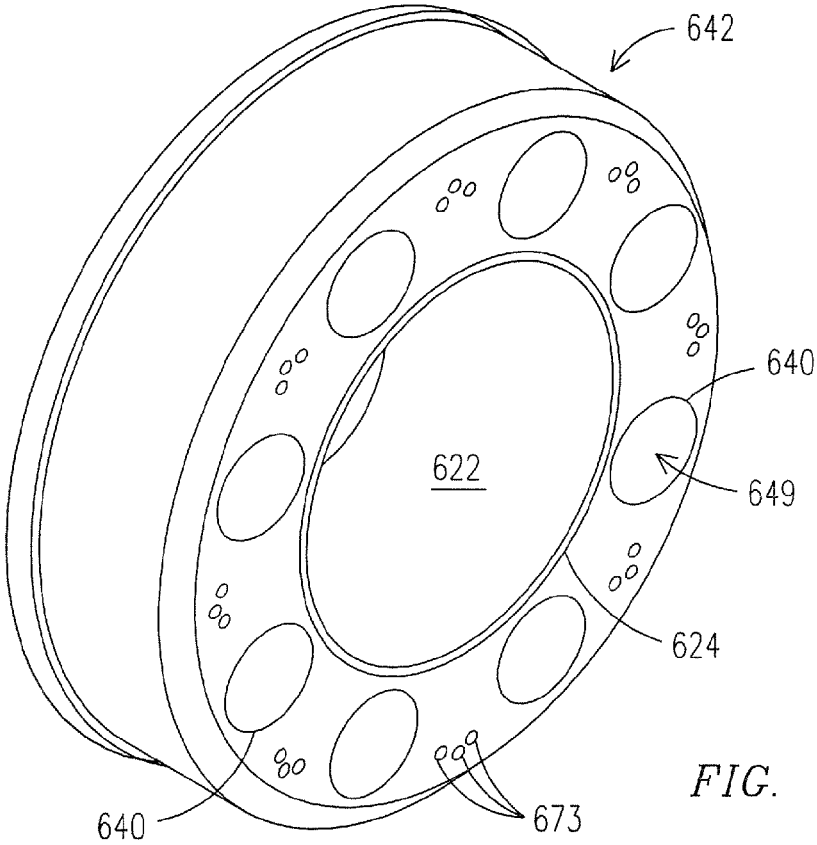

FIGS. 6A and 6B provide, respectively, an upstream side perspective view and a downstream side perspective view, of an exemplary embodiment of the present invention. The overall design of the top plate structure 642 differs somewhat from that depicted in FIGS. 5A-D. FIG. 6A shows a base plate 614 communicating with the flow-directing structures 640. A portion of the base plate 614 is cut away, and remainder 644 interior to the cut away base plate 614 is indicated. A portion 633 of combustor liner (see FIG. 1) surrounds a now-subdivided post-swirler homogenization zone (see FIG. 1) in the space defined within the flow-directing structures 640 and a remainder (see FIG. 4), which is bordered laterally by the portion 633 to the exterior and the conical form of the top plate 622 to the interior. FIG. 6B shows the exits 649 of the flow-directing structures 640 which are aligned in a co-planar fashion with a downstream edge 624 of pilot cone 622. Base plate apertures 625 and top plate apertures 673 are shown but these patterns are not meant to be limiting.

As is known to those skilled in the art, the frequency of the resonance for a Helmholtz resonator, $f_H$, is as follows:

$$f_H = \frac{v}{2\pi}\sqrt{\frac{A}{V_0 L}}$$

where v is the speed of sound in the resonator volume, $V_O$, A is the cross-sectional area of the throat, and L is the length of the throat. The throat in some embodiments only comprises the aperture(s) communicating with the combustion zone and in other embodiments also includes a tubular extension thereto (this extending the overall length of the throat). The throat length L (also referred to by some as the neck length) appears in the denominator since the inertia of the air (or other fluid) is proportional to this length. The resonator volume, $V_O$, also is in the denominator since the spring constant of the air (or other fluid) in the cavity is inversely proportional to its volume. It is noted that providing apertures in the base plate into the cavity of a Helmholtz resonator is viewed to affect the speed of sound therein and thus alter its resonance frequency.

Figure 7:
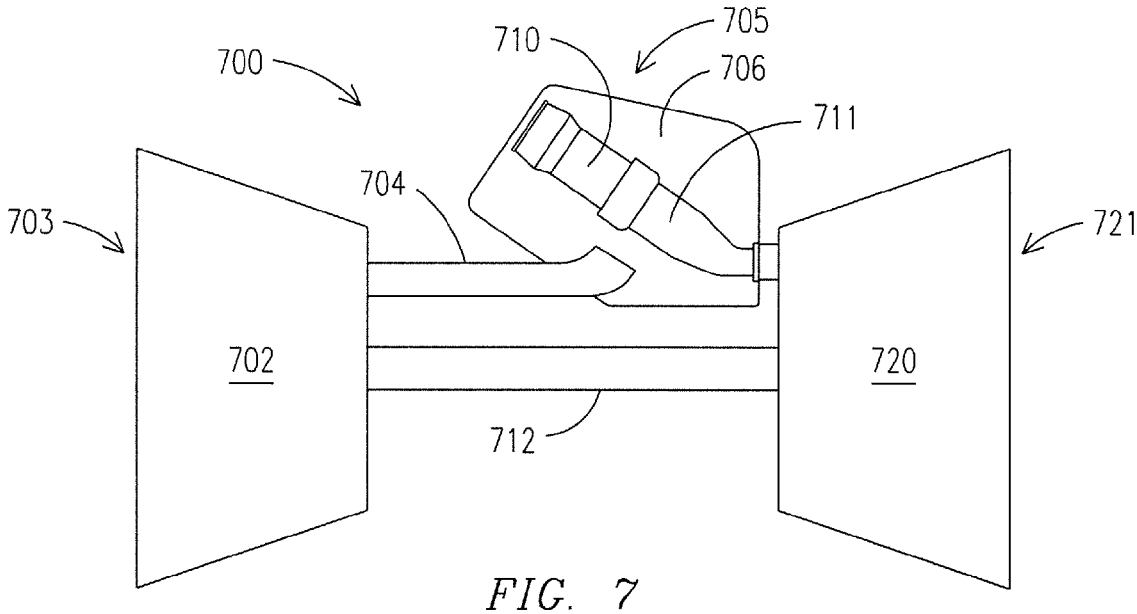
FIG. 7 is a schematic lateral cross-sectional depiction of a prior art gas turbine showing major components.

Embodiments of the present invention are used in gas turbine engines such as are represented by FIG. 7, which is a schematic lateral cross-sectional depiction of a prior art gas turbine 700 showing major components. Gas turbine engine 700 comprises a compressor 702 at a leading edge 703, a turbine 720 at a trailing edge 721 connected by shaft 712 to compressor 702, and a mid-frame section 705 disposed there between. The mid-frame section 705, defined in part by a casing 707 that encloses a plenum 706, comprises within the plenum 706 a combustor 710 (such as a can-annular combustor) and a transition 711. During operation, in axial flow series, compressor 702 takes in air and provides compressed air to an annular diffuser 704, which passes the compressed air to the plenum 706 through which the compressed air passes to the combustor 710, which mixes the compressed air with fuel (not shown), providing combusted gases via the transition 711 to the turbine 720, whose rotation may be used to generate electricity. It is appreciated that the plenum 706 is an annular chamber that may hold a plurality of circumferentially spaced apart combustors 710, each associated with a downstream transition 711. Likewise the annular diffuser 704, which connects to but is not part of the mid-frame section 705, extends annularly about the shaft 712. Embodiments of the present invention may be incorporated into each combustor (such as 710) of a gas turbine engine to achieve the benefits described herein.

All patents, patent applications, patent publications, and other publications referenced herein are hereby incorporated by reference in this application in order to more fully describe the state of the art to which the present invention pertains, to provide such teachings as are generally known to those skilled in the art.

While various embodiments of the present invention have been shown and described herein, it will be obvious that such embodiments are provided by way of example only. Numerous variations, changes and substitutions may be made without departing from the invention herein. Moreover, when any range is described herein, unless clearly stated otherwise, that range includes all values therein and all subranges therein. Accordingly, it is intended that the invention be limited only by the spirit and scope of the appended claims.

What is claimed is:

1. A gas turbine combustor Helmholtz resonator comprising:

a cavity at least partly between a combustor base plate transverse wall and a transverse wall of a top plate structure, wherein the top plate structure additionally comprises an outer shell wall adapted to contact a liner of the combustor, wherein the outer shell wall is oriented transverse to the top plate transverse wall and wherein the outer shell wall extends to the base plate transverse wall to enclose the cavity;

a plurality of base plate transverse wall openings through the base plate transverse wall and into the cavity;

at least two top plate transverse wall apertures through the top plate transverse wall and defining a resonator throat, having a length, and communicating with a combustion zone downstream of the top plate structure transverse wall; and a flow-directing structure between a main swirler assembly and the top plate structure transverse wall that separates a flow path from the cavity, wherein the top plate structure additionally comprises an inward conical member adapted to conform to a pilot cone of the combustor, and wherein the cavity is also partly between the inward conical member and the base plate transverse wall.

2. The gas turbine combustor Helmholtz resonator of claim 1, wherein the inward conical member comprises a plurality of cooling apertures effective to provide a cooling flow to the pilot cone.

3. The gas turbine combustor Helmholtz resonator of claim 1, additionally comprising a tube extending from at least one of the top plate transverse wall apertures into the cavity to extend the resonator throat length.

4. A gas turbine combustor comprising the Helmholtz resonator of claim 1, the cavity defined by at least two partitions that are effective to define the cavity and a second cavity, the combustor additionally comprising a second Helmholtz resonator comprising the second cavity and at least one aperture defining a second resonator throat, having a length, and communicating with the combustion zone downstream of the top plate structure transverse wall.

5. A gas turbine combustor comprising:

a combustor liner defining an interior combustion chamber having a flow-based longitudinal axis, a pilot burner disposed upstream of the combustion chamber along the longitudinal axis, a plurality of main swirler assemblies disposed radially outward of the pilot burner, a base plate comprising openings for the main swirler assemblies and the pilot burner, and a pilot cone having a volume and extending downstream for a distance from the base plate, the pilot cone comprising a pilot cone downstream edge, wherein a post-swirler homogenization zone is defined within the combustor liner between the base plate and a plane including the pilot cone downstream end, and excluding the pilot cone volume;

a top plate comprising a transverse wall parallel to the base plate and extending between the combustor liner and the pilot cone, thereby including at least a portion of the post-swirler homogenization zone, the top plate transverse wall comprising a plurality of top plate transverse wall apertures there through;

an outer shell wall adapted to contact a liner of the combustor and the top plate, wherein the outer shell wall is oriented transverse to the top plate and the outer shell wall extends to the base plate to enclose a cavity between the top plate and the base plate; and for each of the main swirler assemblies, a flow-directing structure extending from a downstream end of the respective main swirler assembly to a passageway in the top plate transverse wall, effective to constrain a fuel/oxidizer mixture exiting the main swirler assembly to a path defined at least in part by the flow-directing structure;

wherein a Helmholtz resonator comprises the cavity comprising at least a portion of a remainder of the post-swirler homogenization zone not included in said paths, wherein the top plate transverse wall apertures provide fluid communication between the cavity and the combustion chamber, and wherein a flow directing structure aperture provides fluid communication between the cavity and the path, wherein the to plate additionally comprises an inward conical member adapted to conform to the pilot cone of the combustor, and wherein the cavity is also partly between the inward conical member and the base plate.

6. The gas turbine combustor of claim 5, wherein the top plate is aligned along the plane that includes the pilot cone downstream end.

7. The gas turbine combustor of claim 5, wherein at least one partition is provided in the remainder to divide the reminder into at least two Helmholtz resonators.

8. The gas turbine combustor of claim 5, wherein base plate apertures in the base plate communicate with and supply air to the Helmholtz resonator cavity.

9. The gas turbine combustor of claim 5, additionally comprising a tube extending into the cavity from at least one of the top plate transverse wall apertures communicating with said cavity.

10. A gas turbine combustor comprising, within a combustor liner, a plurality of main swirler assemblies disposed radially outward of a pilot burner, a base plate comprising openings for the main swirler assemblies and the pilot burner, and a pilot cone having a volume and extending downstream for a distance from the base plate and ending at a pilot cone downstream edge, and a combustion zone downstream of the pilot cone and within the combustor liner, wherein the improvement comprises:

a top plate structure spaced downstream from the base plate and comprising a top plate transverse wall comprising a plurality of top plate transverse wall apertures there through, wherein the top plate structure additionally comprises an outer shell wall adapted to contact the liner of the combustor, wherein the outer shell wall is oriented transverse to the top plate transverse wall and extends to the base plate to enclose a cavity between the top plate transverse wall and the base plate; and at least one flow-directing structure extending from one of the main swirler assemblies to a passageway in the top plate structure transverse wall, the flow directing structure comprising a flow directing structure wall comprising a flow directing structure aperture there through, wherein a Helmholtz resonator comprises a cavity at least partly between the base plate and the transverse wall of the top plate structure and excluding a path defined by the at least one flow-directing structure, the Helmholtz resonator further comprising a throat defined at least in part by the plurality of top plate transverse wall apertures and communicating between the cavity and the combustion zone, and wherein the flow directing structure aperture provides fluid communication between the cavity and a flow path defined by the flow directing structure, wherein the top plate structure additionally comprises an inward conical member adapted to conform to the pilot cone of the combustor, and wherein the cavity is also partly between the inward conical member and the base plate.

* * * * *